US010580243B2

(12) United States Patent
Harding

(10) Patent No.: US 10,580,243 B2
(45) Date of Patent: Mar. 3, 2020

(54) CONDITIONAL AND SITUATIONAL BIOMETRIC AUTHENTICATION AND ENROLLMENT

(71) Applicant: ImageWare Systems, Inc., San Diego, CA (US)

(72) Inventor: David Harding, Portland, OR (US)

(73) Assignee: ImageWare Systems, Inc., San Diego, CA (US)

( * ) Notice: Subject to any disclaimer, the term of this patent is extended or adjusted under 35 U.S.C. 154(b) by 0 days.

(21) Appl. No.: 14/254,751

(22) Filed: Apr. 16, 2014

(65) Prior Publication Data

US 2014/0313007 A1 Oct. 23, 2014

Related U.S. Application Data

(60) Provisional application No. 61/812,599, filed on Apr. 16, 2013, provisional application No. 61/812,624, filed on Apr. 16, 2013.

(51) Int. Cl.
*G07C 9/00* (2020.01)
*G07C 9/37* (2020.01)

(52) U.S. Cl.
CPC ..... *G07C 9/37* (2020.01); *G07C 2209/14* (2013.01)

(58) Field of Classification Search
None
See application file for complete search history.

(56) References Cited

U.S. PATENT DOCUMENTS

| | | | | |
|---|---|---|---|---|
| 5,704,029 | A | | 12/1997 | Wright, Jr. |
| 5,930,804 | A | * | 7/1999 | Yu ..... G06F 21/32 |
| 5,963,136 | A | | 10/1999 | O'Brien |
| 6,014,427 | A | | 1/2000 | Hanson et al. |
| 6,095,985 | A | | 8/2000 | Raymond et al. |
| 6,112,049 | A | | 8/2000 | Sonnenfeld |
| 6,138,158 | A | | 10/2000 | Boyle et al. |
| 6,219,694 | B1 | | 4/2001 | Lazaridis et al. |
| 6,256,666 | B1 | | 7/2001 | Singhal |
| 6,298,231 | B1 | | 10/2001 | Heinz |
| 6,333,973 | B1 | | 12/2001 | Smith et al. |
| 6,463,462 | B1 | | 10/2002 | Smith et al. |
| 6,463,464 | B1 | | 10/2002 | Lazaridis et al. |
| 6,487,401 | B2 | | 11/2002 | Suryanarayana et al. |
| 6,594,349 | B2 | | 7/2003 | Fortman |
| 6,610,105 | B1 | | 8/2003 | Martin, Jr. et al. |
| 6,631,400 | B1 | | 10/2003 | DiStefano, III |
| 6,721,578 | B2 | | 4/2004 | Minear et al. |
| 6,767,211 | B2 | | 7/2004 | Hall et al. |

(Continued)

FOREIGN PATENT DOCUMENTS

| | | | |
|---|---|---|---|
| WO | 02/087267 | A1 | 10/2002 |
| WO | 03/015430 | A1 | 2/2003 |

*Primary Examiner* — Chico A Foxx
(74) *Attorney, Agent, or Firm* — Sheppard Mullin Richter & Hampton LLP

(57) ABSTRACT

The present invention provides a system for conditionally selecting biometric modalities for biometric authentication at authentication run time. The inventive concept uses programmatic logic to identify which biometric modalities to use for authenticating a user. The software module for selecting biometric modalities includes, a plurality of rules or conditional logic for selecting one or more biometric modalities required to authenticate a user requesting a secure action.

18 Claims, 7 Drawing Sheets

(56) References Cited

U.S. PATENT DOCUMENTS 6,769,009 B1 7/2004 Reisman
6,807,254 B1 10/2004 Guedalia et al.
6,826,614 B1 11/2004 Hanmann et al.
6,873,688 B1 3/2005 Aarnio
6,889,054 B2 5/2005 Himmel et al.
6,898,569 B1 5/2005 Bansal et al.
6,961,327 B2 11/2005 Niu
6,968,178 B2 11/2005 Pradhan et al.
6,978,118 B2 12/2005 Vesikivi et al.
6,987,945 B2 1/2006 Corn et al.
7,002,476 B2 2/2006 Rapchak
7,058,036 B1 6/2006 Yu et al.
7,076,244 B2 7/2006 Lazaridis et al.
7,113,977 B1 9/2006 Baker et al.
7,133,506 B1 11/2006 Smith
7,254,619 B2 * 8/2007 Mekata ..... G06F 21/32 707/999.104
7,287,689 B2 * 10/2007 Tidwell ..... G06Q 20/042 235/379
7,293,019 B2 11/2007 Dumais et al.
7,512,567 B2 * 3/2009 Bemmel ..... G06Q 20/20 705/64
8,122,259 B2 * 2/2012 Menczel ..... G06K 9/00885 340/5.52
8,255,698 B2 * 8/2012 Li ..... G06F 21/32 455/433
8,301,897 B2 * 10/2012 Turner ..... H04L 9/3271 380/255
8,584,219 B1 * 11/2013 Toole ..... G06F 21/60 726/25
8,694,315 B1 * 4/2014 Sheets ..... G06Q 20/40145 704/246
8,768,249 B2 * 7/2014 Avadhanam ..... G06F 9/44505 340/501
8,826,030 B2 * 9/2014 White ..... G06F 21/32 713/168
8,887,259 B1 * 11/2014 Harding ..... G06F 21/32 713/185
9,100,825 B2 * 8/2015 Schultz ..... H04W 12/06
9,430,629 B1 * 8/2016 Ziraknejad ..... G06F 21/335
2001/0037264 A1 11/2001 Husemann et al.
2001/0047294 A1 11/2001 Rothschild
2001/0054108 A1 12/2001 Lincoln et al.
2002/0006793 A1 1/2002 Kun-Szabo et al.
2002/0006826 A1 1/2002 Hansted
2002/0015403 A1 2/2002 McConnell et al.
2002/0021696 A1 2/2002 Minborg
2002/0032595 A1 3/2002 Hundscheidt et al.
2002/0034292 A1 3/2002 Tuoriniemi et al.
2002/0052198 A1 5/2002 Savilaakso
2002/0052841 A1 5/2002 Guthrie et al.
2002/0054090 A1 5/2002 Silva et al.
2002/0055872 A1 5/2002 LaBrie et al.
2002/0057678 A1 5/2002 Jiang et al.
2002/0065097 A1 5/2002 Brockenbrough et al.
2002/0077076 A1 6/2002 Suryanarayana et al.
2002/0077080 A1 6/2002 Greene
2002/0077876 A1 6/2002 O'Meara et al.
2002/0083127 A1 6/2002 Agrawal
2002/0087596 A1 7/2002 Lewontin
2002/0087643 A1 7/2002 Parsons et al.
2002/0091797 A1 7/2002 Wallenius et al.
2002/0095465 A1 7/2002 Banks et al.
2002/0099544 A1 7/2002 Levitt et al.
2002/0099545 A1 7/2002 Levitt et al.
2002/0107002 A1 8/2002 Duncan et al.
2002/0107985 A1 8/2002 Hwang et al.
2002/0115456 A1 8/2002 Narinen et al.
2002/0119793 A1 8/2002 Hronek et al.
2002/0123335 A1 9/2002 Luna et al.
2002/0126708 A1 9/2002 Skog et al.
2002/0128001 A1 9/2002 Shuttleworth
2002/0137525 A1 9/2002 Fleischer et al.
2002/0141560 A1 10/2002 Khayatan et al.
2002/0142763 A1 10/2002 Kolsky
2002/0145043 A1 10/2002 Challa et al.
2002/0155848 A1 10/2002 Suryanarayana
2002/0159569 A1 10/2002 Hasegawa
2002/0169604 A1 11/2002 Damiba et al.
2002/0169605 A1 11/2002 Damiba et al.
2002/0169611 A1 11/2002 Guerra et al.
2002/0169613 A1 11/2002 Damiba
2002/0169614 A1 11/2002 Fitzpatrick et al.
2002/0173961 A1 11/2002 Guerra
2002/0174068 A1 11/2002 Marsot
2002/0174248 A1 11/2002 Morriss
2002/0176379 A1 11/2002 Wallenius et al.
2002/0184033 A1 12/2002 Fitzpatrick et al.
2002/0184391 A1 12/2002 Phillips
2002/0186845 A1 12/2002 Dutta et al.
2002/0187775 A1 12/2002 Corrigan et al.
2002/0188443 A1 12/2002 Reddy et al.
2002/0188451 A1 12/2002 Guerra et al.
2002/0188714 A1 12/2002 Bouthors
2002/0191795 A1 12/2002 Wills
2002/0193997 A1 12/2002 Fitzpatrick et al.
2002/0194331 A1 12/2002 Lewis et al.
2003/0003898 A1 1/2003 Banerjee et al.
2003/0006912 A1 1/2003 Brescia
2003/0013433 A1 1/2003 alSafadi
2003/0115152 A1 6/2003 Flaherty
2003/0142039 A1 7/2003 Minear et al.
2004/0034544 A1 2/2004 Fields et al.
2004/0148526 A1 * 7/2004 Sands ..... G06F 21/32 726/5
2004/0254836 A1 12/2004 Emoke Barabas et al.
2006/0021003 A1 * 1/2006 Fisher ..... G06F 21/32 726/1
2006/0031337 A1 2/2006 Kim
2006/0075019 A1 4/2006 Donovan et al.
2006/0163344 A1 * 7/2006 Nwosu ..... G06Q 20/105 235/380
2006/0179072 A1 8/2006 Eves et al.
2006/0240851 A1 10/2006 Washburn
2006/0256130 A1 11/2006 Gonzalez
2007/0050636 A1 * 3/2007 Menczel ..... G06K 9/00885 713/186
2007/0100648 A1 5/2007 Borquez et al.
2007/0150745 A1 * 6/2007 Peirce ..... G06F 21/32 713/186
2008/0072056 A1 * 3/2008 Turner ..... H04L 9/3271 713/182
2008/0101658 A1 * 5/2008 Ahern ..... G06F 21/32 382/115
2009/0289760 A1 * 11/2009 Murakami ..... G06K 9/00885 340/5.82
2010/0005518 A1 * 1/2010 Tirpak ..... H04L 67/306 726/6
2010/0162386 A1 * 6/2010 Li ..... G06F 21/32 726/19
2010/0174914 A1 * 7/2010 Shafir ..... G06K 9/00067 713/186
2010/0176916 A1 * 7/2010 Baucom ..... G07C 9/00158 340/5.5
2010/0228692 A1 * 9/2010 Guralnik ..... G06K 9/6293 706/12
2010/0245042 A1 * 9/2010 Tsubaki ..... G06F 21/32 340/5.82
2011/0083173 A1 * 4/2011 Baghdasaryan ..... G06Q 20/10 726/7
2011/0211735 A1 * 9/2011 Langley ..... G06F 21/32 382/115
2011/0231911 A1 * 9/2011 White ..... H04L 63/08 726/7
2012/0268241 A1 * 10/2012 Hanna ..... G06F 21/32 340/5.52
2013/0132091 A1 * 5/2013 Skerpac ..... G10L 17/005 704/273
2013/0133049 A1 * 5/2013 Peirce ..... G06F 21/32 726/6

(56) References Cited

U.S. PATENT DOCUMENTS

| | | | | |
|---|---|---|---|---|
| 2013/0212655 | A1* | 8/2013 | Hoyos | G06K 9/00107 726/5 |
| 2013/0259330 | A1* | 10/2013 | Russo | G06K 9/00087 382/124 |
| 2013/0267204 | A1* | 10/2013 | Schultz | H04W 12/06 455/411 |
| 2014/0023246 | A1* | 1/2014 | Bolding | G06K 9/00885 382/118 |
| 2014/0172707 | A1* | 6/2014 | Kuntagod | G06Q 20/40145 705/44 |
| 2014/0230033 | A1* | 8/2014 | Duncan | G06F 21/32 726/7 |
| 2015/0035643 | A1* | 2/2015 | Kursun | G07C 9/00158 340/5.52 |
| 2015/0220716 | A1* | 8/2015 | Aronowitz | G06F 21/32 706/12 |

* cited by examiner

CONDITIONAL AND SITUATIONAL BIOMETRIC AUTHENTICATION AND ENROLLMENT

CROSS-REFERENCE TO RELATED APPLICATIONS

The present application claims priority to U.S. Provisional Patent Application No. 61/812,599, filed on Apr. 16, 2013, and entitled "System for Conditional and Situational Biometric Authentication," and U.S. Provisional Patent Application No. 61/812,624, filed on Apr. 16, 2013, and entitled "System for Conditional and Situational Biometric Enrollment," the disclosures of all of which are herein incorporated by reference in their entirety.

BACKGROUND OF THE INVENTION

1. Field of Invention

This invention relates generally to identity management systems and more specifically, to techniques for conditional and situational biometric authentication and enrollment.

2. Description of Related Art

For most individuals, the need to establish personal identity occurs many times a day. A person might have to establish identity in order to gain access to physical spaces, computers, bank accounts, personal records, restricted areas, reservations, and the like. Identity is typically established by something we have (e.g., a key, driver license, bank card, credit card, etc.), something we know (e.g., computer password, PIN number, etc.), or some unique and measurable biological feature (e.g., our face recognized by a bank teller or security guard, etc.).

The most secure means of identity is a biological (or behavioral) feature that can be objectively and automatically measured, and resistant to impersonation, theft, or other forms of fraud. The use of measurements derived from human biological features, biometrics, to identify individuals is hence a rapidly emerging science.

Biometrics is a generic term for biological characteristics that can be used to distinguish one individual from another, particularly through the use of digital equipment. For example, a biometric can be a fingerprint. Trained analysts have long been able to match fingerprints in order to identify individuals. More recently, computer systems have been developed to match fingerprints automatically. Further examples of biometrics that have been used to identify, or authenticate the identity of, individuals include: 2D face image, 3D face image, hand geometry, single fingerprint, ten finger live scan, iris, palm, full hand, signature, ear, finger vein, retina, DNA and voice. Other biometrics may include characteristic gaits, lip movements and the like. Furthermore, additional biometrics are continuously being developed or discovered.

The implementation of biometric systems requires the coordination between the individual and the organization or business implementing the technology. Generally, the implementation of biometrics systems requires an initial enrollment process. This means that a sample biometric measurement is provided by the individual, along with personal identifying, demographic information, such as, for example, his/her name, address, telephone number, an identification number (e.g., a social security number), a bank account number, a credit card number, a reservation number, or some other information unique to that individual. The sample biometric is stored along with the personal identification data in a database.

Digital equipment for capturing biometrics varies from place to place or from device to device, and a person can require authentication from any of the different places or devices. Different places, devices or modalities require different conditions or adjustments for biometric authentication, where different requested actions also require specific security adjustments.

Thus, a need exists for a biometric system that handles authentication depending on the condition or situation of the person requiring authentication or the action requiring authentication.

SUMMARY OF THE INVENTION

According to an embodiment of the present invention, a multi-modal biometric system using situational and conditional authentication is disclosed. The system comprises a computing device, such as for example a personal computer or server for providing or hosting a secure action, a multi-modal biometric matching engine, a biometric data cache, a software module that include rules to manage situational and conditional authentication, and one or more devices configured to access the secure action. The system may be configured in a centralized architecture or as distributed architecture.

The system allows the conditions for biometric authentication to change dynamically according to the situation of the user or the action requested. The system includes a software component with a set of rules or programmatic logic that determines appropriate biometric modalities for authentication and appropriate thresholds for each modality depending on the type of action requested, or the location or device from which the action is requested. In another embodiment of the invention, the system selects biometric modalities to be used for authentication depending on the available biometrics enrolled for the user who requires authentication. In yet another embodiment, the system select biometric modalities to be used for authentication depending on the biometrics modalities supported by the device or place from where the action is being requested. Other embodiments of the system may adjust the number of biometric modalities to be used depending on the action being requested. The system may also adjust or select biometric modalities depending on the quality provided by the biometric capture device.

Further embodiments of the system may adjust the thresholds for the selected modalities depending on the action being requested. The system may adjust the biometric modalities required or the thresholds for the selected biometric modalities depending on historic data associated with the action being requested or the user requesting the action.

In an embodiment of the invention, a method for biometric authentication of a user comprises: identifying an action request of a user of a device; determining a security level associated with the identified action request of the user of the device; determining one or more biometric modalities supported by the device; selecting a number of biometric modalities from the determined one or more biometric modalities supported by the device based on the determined security level; requesting biometrics of the user for the selected number of biometric modalities; receiving biometrics of the user for the selected number of biometric modalities; and requesting biometric verification of the received biometrics. The step of determining a security level can also based on location of the device or type of the device. The step of requesting biometric verification of the received biometrics comprises adjusting a scoring threshold of the requested biometric verification based on the determined security level. The identified action request can involve a monetary amount and the step of determining a security level is also based on the monetary amount. The identified action request can involve access to information and the step of determining a security level is also based on type of the information. Granting or denying the action request is based on the outcome of the requested biometric verification. The step of determining a security level is also based on identity of the user.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF EMBODIMENTS

Figure 1:
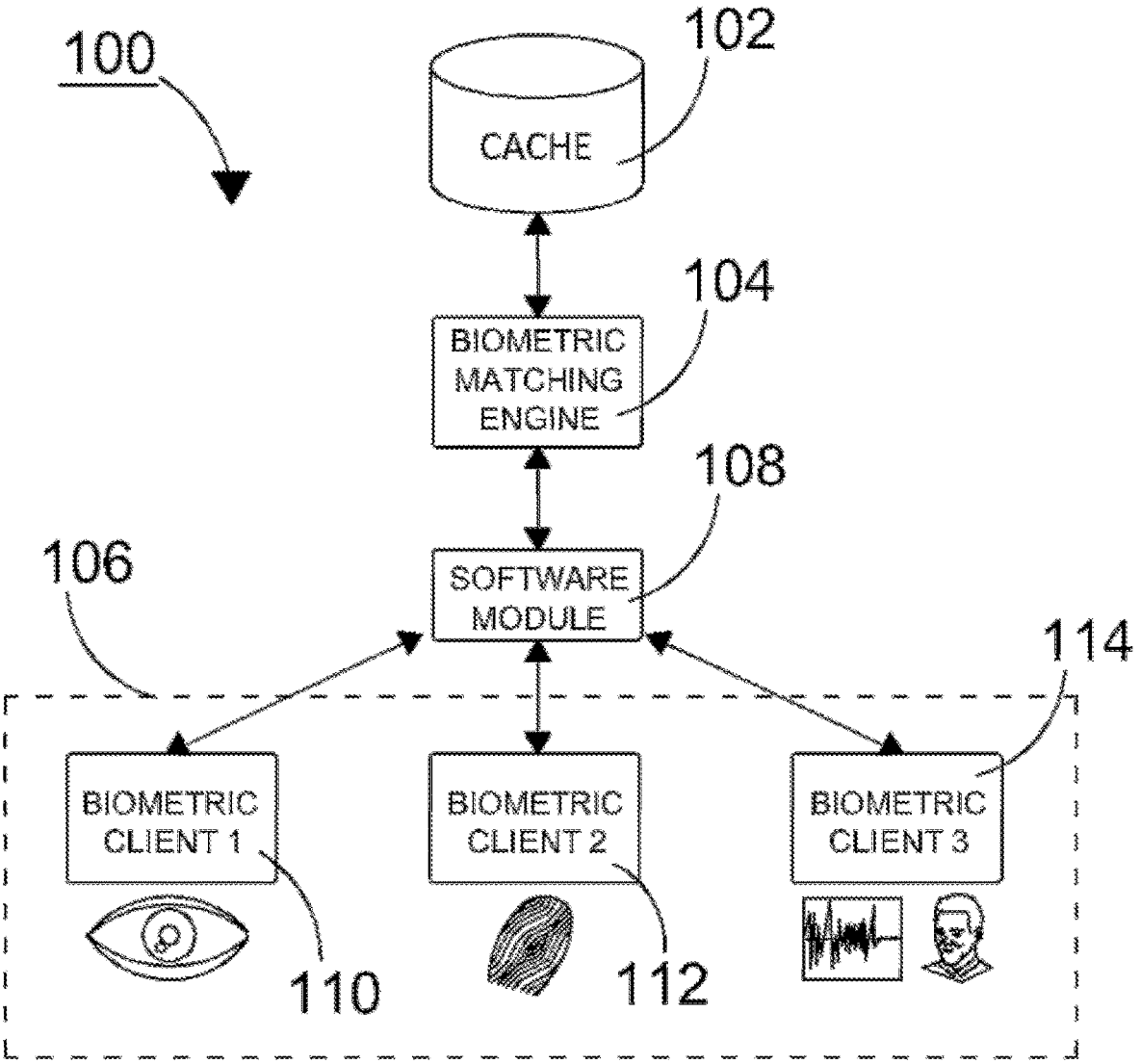
FIG. 1 illustrates a centralized system for situational and conditional biometric authentication (SSCBA) according to an embodiment of the invention.

Preferred embodiments of the present invention and their advantages may be understood by referring to FIGS. 1-7, wherein like reference numerals refer to like elements. The descriptions and features disclosed herein can be applied to various interactive messaging systems, the identification and implementation of which are apparent to one of ordinary skill in the art. The features described herein are broadly applicable to any type of communications technologies and standards.

As used here, the following terms have the following definitions:

"Conditional" refers to one or more conditions that influence adjustments either on thresholds or modalities for biometric authentication.

"Situational biometrics" refers to specific biometrics that can be used depending on biometrics supported for authentication by the client device or location.

"Biometric authentication" refers to methods for uniquely recognizing humans based upon one or more intrinsic physical or behavioral traits.

"Biometric modalities" refers to different categories and/or types of biometric identifiers.

"Biometric verification" refers to the use of biometric authentication to verify the identity of a person.

"Biometric identification" refers to the use of biometric authentication to identify a person among a biometrically enrolled population.

"Biometric probe" refers to any captured biometric that is used to compare with or match against one or more prior biometric enrollments.

"Biometric score" is any probability score that a given biometric enrollment and a given biometric probe represent the same identity.

"Biometric template" refers to any binary, numerical, alphabetical or alphanumeric representation of a single biometric generated by a biometric algorithm.

"Biometric capture" refers to using a biometric input device or system to capture biometric data in the form of images, templates, or other form.

"Biometric data" refers to data that is used to verify or identify a person based on physical traits or behaviors. Biometric data includes, but is not limited to images of fingerprints, faces, irises, and binary data generated by biometric algorithms.

"Enrolled biometrics" refers to the first biometric templates stored in a database for future comparison processes.

"Biometric thresholds" refers to a range of scores that determine the level of success of a biometric matching process.

FIG. 1 illustrates a centralized system for situational and conditional biometric authentication and/or enrollment 100 according to an embodiment of the invention. System 100 comprises a biometric data cache 102, which can be any database engine, such as commercial known database engines like Oracle, SQL Server, MySQL, and/or any database engine configured to handle biometric templates, the identification and implementation of which are apparent to one of ordinary skill in the art. System 100 comprises a multi-modal biometric matching engine 104, such as those disclosed U.S. Pat. Nos. 7,298,873; 7,362,884; 7,596,246; and 7,606,396; which are all incorporated by reference in their entireties.

System 100 comprises a plurality of biometric clients 106. Exemplary biometric clients 106 include, but are not limited to computing devices such as, but not limited to kiosks, automated teller terminals, desktop computers (e.g., personal computers), laptops, and mobile devices (e.g., smartphones, tablets, phablets, and personal digital assistants) having installed thereon a suitable operating system and biometric software. Each biometric client 106 supports at least one biometric modality.

A software module 108 is integrated in system 100 to handle situational and conditional biometric authentication and/or enrollment. Software module 108 includes software code that uses programmatic logic to establish and manage a plurality of rules or conditional logic. Software module 108 is communicatively coupled with biometric matching engine 104 and biometric clients 106 to manage biometric authentication and enrollment efforts according to the programmed conditional logic.

Each biometric client 106 supports one or more different biometric modalities. Software module 108 contains programmed logic to identify which biometric modalities are supported by each biometric client 106. In an exemplary embodiment of the invention as shown, three biometric clients 106 authenticate through software module 108 to request an action. A first biometric client 110 support iris, a second biometric client 112 supports fingerprint, and a third biometric client 114 supports voice and face.

Figure 2:
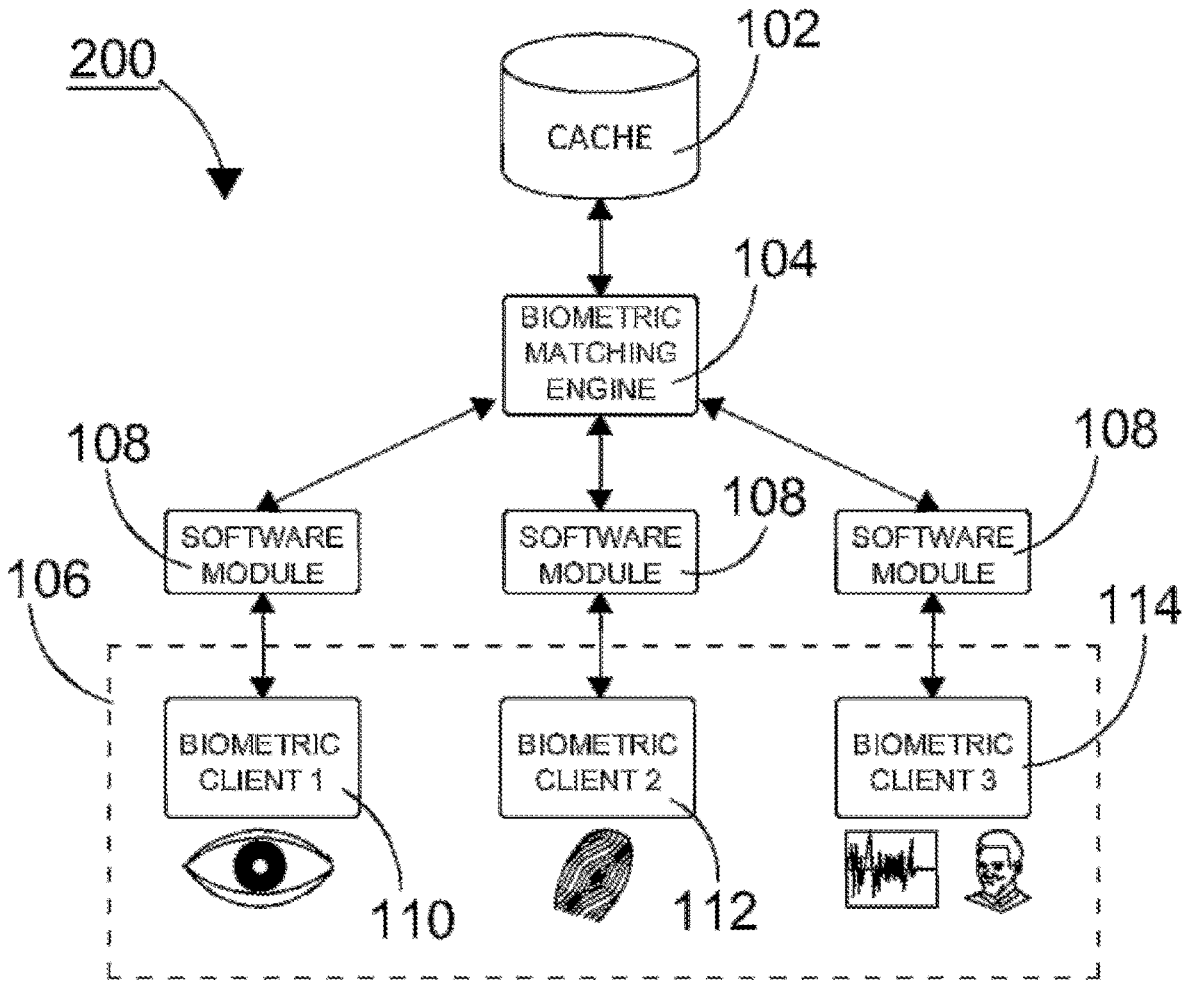
FIG. 2 illustrates a distributed system for situational and conditional biometric authentication according to an embodiment of the invention.

FIG. 2 illustrates a distributed system for situational and conditional biometric authentication and/or enrollment 200 according to an embodiment of the invention. The software module 108 is integrated as part of each biometric client 106. Conditions can be applied directly at the biometric client 106 level before sending a request to the biometric matching engine 104. In another embodiment of the invention, a combination of distributed and centralized system is implemented. For example, a software module 108 exists at a server level and a second software module 108 exists at the biometric client 106 level.

Figure 3:
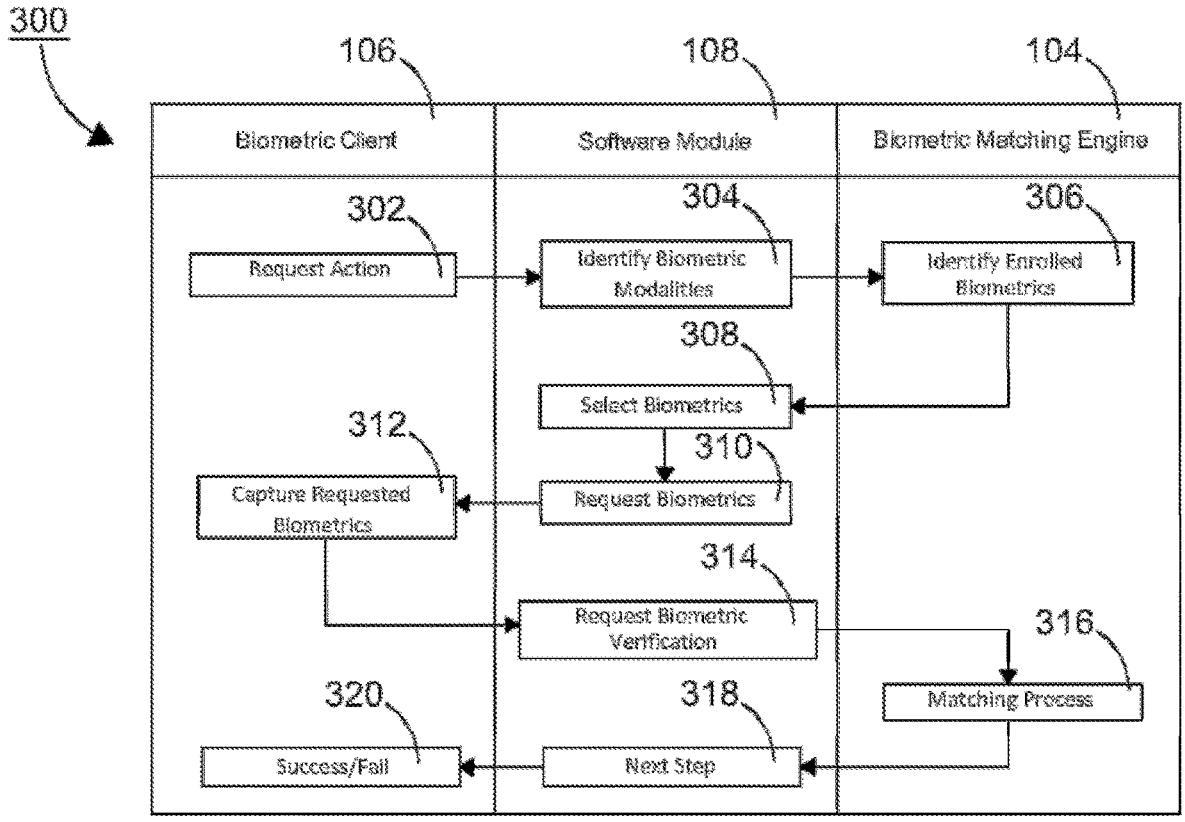
FIG. 3 illustrates an authentication process according to an embodiment of the invention.

FIG. 3 illustrates an authentication process 300 according to an embodiment of the invention. The process is implemented by system 100 or 200. The authentication process 300 is for conditionally selecting biometric modalities for biometric authentication at authentication run time. First, biometric client 106 requests (step 302) an action, which can be any action, such as requesting access to an application, transferring money from a bank account, requesting information and/or any other action that requires authentication. Software module 108 then identifies (step 304) which biometric client 106 is requesting action 302 in order to identify biometric modalities supported by that biometric client 106. Software module 108 identifies (step 306) enrolled biometrics for that client in biometric matching engine 104. Software module 108 then compares biometric modalities supported by biometric client 106 to enrolled biometrics for that client and selects (step 308) biometrics to be used accordingly for authentication.

Software module 108 then requests (step 310) biometrics to biometric client 106. Biometric client 106 then captures (step 312) requested biometrics and sends them to software module 108. Software module 108 then requests (step 314) biometric verification to biometric matching engine 104. Biometric matching engine 104 compares the received biometrics against previously stored biometric templates in a matching process (step 316). From the matching process, biometric scores are generated and returned to software module 108. The score returned serves as an indication that the individual authenticated is in fact who he/she claims to be. Software module 108 then analyzes the score and determines a next step (step 318) if necessary. Next step 318 can be any action programmatically determined, such as for example an access grant to an application, request verification, request another biometric, transfer money or any other action determined by the service or application requiring authentication. Biometric client 106 then receives (step 320) a success/fail confirmation.

In another embodiment of the invention, software module 108 adjusts the required biometric modalities depending on the action requiring authentication. Software module 108 contains different programmed rules that determine which biometric modalities are required for different actions. For example, biometric client 106 may wish to transfer a small amount of money from their bank account to another account for which software module 108 determines that a single biometric modality is needed to authenticate the user and allow the transfer; however, if biometric client 106 wants to transfer a larger amount of money, software module 108 determines that additional biometric modalities are required for authentication.

Figure 4:
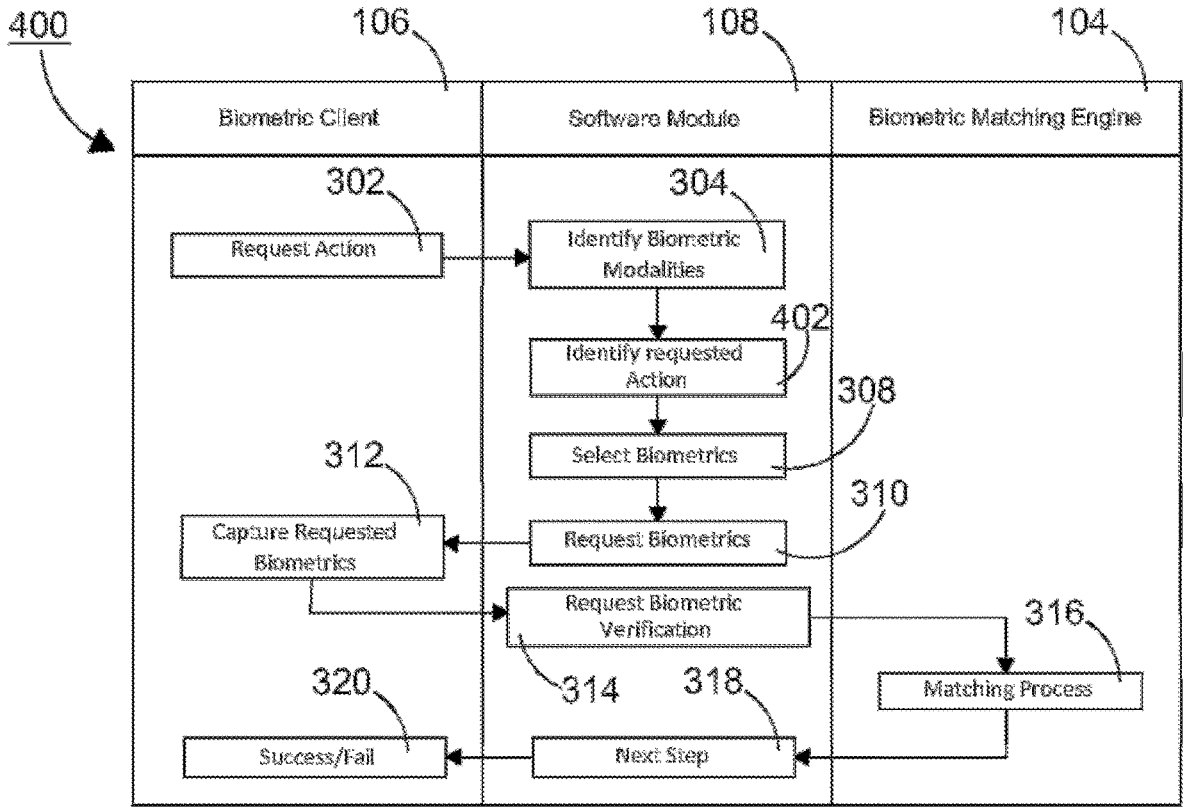
FIG. 4 illustrates an authentication process according to an embodiment of the invention.

FIG. 4 illustrates an authentication process 400 according to an embodiment of the invention. Here, the biometric modalities to be used are determined by the requested action. First, biometric client 106 requests (step 302) an action that require authentication. Software module 108 then identifies (step 304) which biometric client 106 is requesting action in order to identify biometric modalities supported by that biometric client 106. Software module 108 identifies (step 402) requested action and selects (step 308) biometrics based on programmed rules or logic that determine the level of security required to perform action. If none of the selected biometrics are available in biometric data cache 102 for biometric client 106, biometric client 106 is denied permission for action or is requested to enroll biometrics for the selected modality.

Software module 108 then requests (step 310) biometrics to biometric client 106. Biometric client 106 then captures (step 312) requested biometrics and sends them to software module 108. Software module 108 then requests (step 314) biometric verification to biometric matching engine 104. Biometric matching engine 104 compares the received biometrics against previously stored biometric templates in matching process 316. From the matching process 316, biometric scores are generated and returned to software module 108. The score returned serves as an indication that the individual authenticated is in fact who he/she claims to be. Software module 108 then analyzes the score and determines (step 318) a next step, if necessary. Next step can be any action programmatically determined, such as for example grant access to an application, request verification, request another biometric, transfer money or any other action determined by the service or application requiring authentication. Biometric client 106 then receives (step 320) a success/fail confirmation.

In another embodiment of the invention, software module 108 adjusts the required biometric thresholds depending on the action requiring authentication. Software module 108 includes different programmed rules or logic that may adjust biometric authentication thresholds based on the action requiring authentication. Biometric thresholds can be a range of scores that determine success or failure of the authentication process from the score returned in matching process 316. For example, the biometric scoring threshold for transferring a large sum of money in a banking environment could be adjusted substantially higher, while requesting a banking statement could require a substantially lower biometric scoring threshold. Software module 108 may also include programmed rules or logic for adjusting both biometric thresholds and modalities depending on the action requiring authentication. For example, the biometric scoring threshold for transferring a large sum of money in a banking environment could be adjusted substantially higher, while requiring additional biometric modalities also.

In another embodiment of the invention, software module 108 keeps historic data from previous authentication attempts. Software module 108 includes programmed rules or logic that adjusts biometric thresholds, modalities or both depending on historic data. For example, the biometric scoring threshold for transferring a large sum of money in a banking environment could be adjusted based on the alleged identity of the user of if the user has not attempted a large transfer before. In another example, a different biometric modality is selected if a user presents a history of continuous fails using certain biometric modality.

As an example of employing the present invention, system 100 is applied to a bank. A user previously enrolls in the system 100 and different biometrics templates are stored in biometric data cache 102 for future authentications. First biometric client 110 is a branch of the bank with support for iris biometrics. Second biometric client 112 is a branch ATM machine with support for fingerprint. Third biometric client 114 is the user's smartphone with support for voice and face biometrics. The user's smartphone comprises a bank application, e.g., a software app hosted by a financial institution. The user requests access to the application from second biometric client 112. Software module 108 identifies biometric modalities 304 supported by second biometric client 112. Software module 108 then requests an iris biometric from second biometric client 112 for authentication.

In another example, the user requests access to the application from third biometric client 114 via the bank application. Software module 108 identifies biometric modalities 304 supported by third biometric client 114. Software module 108 then compares supported biometrics for third biometric client 114 with the available enrolled biometrics for that user stored in biometric data cache 102. The user may only have voice biometric templates stored in biometric data cache 102; therefore software module 108 requests a voice biometric from third biometric client 114 for authentication.

In another example, the user requests access to the application from third biometric client 114. Software module 108 identifies biometric modalities 304 supported by third biometric client 114. Software module 108 then requests a voice biometric. A subsystem of software module 108 is communicatively coupled with third biometric client 114. The subsystem determines that voice is not appropriate for authentication (e.g., the user is in a loud environment) and suggests or request another biometric modality.

In yet another example, the user accesses the application from third biometric client 114. The user requests to transfer a large amount of money from their bank account. Software module 108 identifies biometric modalities 304 supported by third biometric client 114. Software module 108 then adjusts the required biometrics modalities to allow the transaction; therefore software module 108 may request a voice biometric and face biometrics from third biometric client 114 for authentication.

In yet another example, the user accesses the application from third biometric client 114. The user requests to transfer a large amount of money from their bank account. Software module 108 identifies biometric modalities 304 supported by third biometric client 114. Current thresholds for this type of transaction are typically set low for small amounts; however high amounts require higher thresholds to ensure security. Software module 108 then adjusts the thresholds of the biometric verification. Success or failure may be determined by matching process 316 using the adjusted thresholds.

Figure 5:
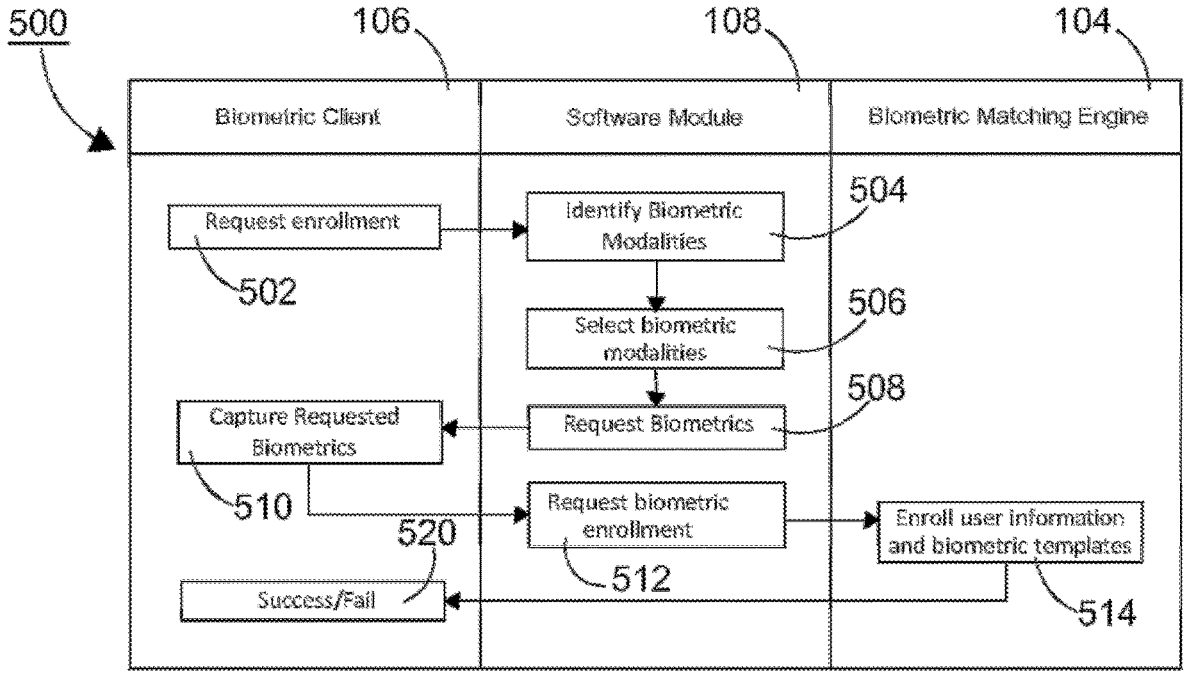
FIG. 5 illustrates a situational biometric enrollment process according to an embodiment of the invention.

FIG. 5 illustrates a situational biometric enrollment process 500 according to an embodiment of the invention. Situational biometric enrollment process 500 can be performed by system 100 or 200. The process 500 begins when biometric client 106 requests (step 502) an enrollment. Software module 108 then identifies (step 504) which biometric client 106 is requesting enrollment in order to identify biometric modalities supported by biometric client 106. For example, if biometric client 106 is using a device like a mobile phone that supports face (by taking a picture) and voice (by providing voice input through a microphone) software module 108 identifies both these supported modalities for that mobile phone.

Software module 108 then selects (step 506) biometrics depending on the identified biometric modalities available for that biometric client 106, and subsequently requests (step 508) biometrics required for the enrollment. Software module 108 also contains a set of programmed rules that select biometrics depending on other conditions such as selecting the most appropriate biometrics for specific applications.

Continuing the situational biometric enrollment process 500, biometric client 106 then captures (step 510) requested biometrics and sends them to software module 108. Software module 108 subsequently requests (step 512) biometric enrollment. Biometric matching engine 104 then enrolls (step 514) user information and biometric templates by storing biographic/demographic data along with the user's associated biometric templates in biometric data cache 102 for future authentication processes. In another embodiment of the invention, biographic and demographic data are also stored in separate data caches from biometric templates. Biometric client 106 then receives (step 520) a success/fail confirmation.

Figure 6:
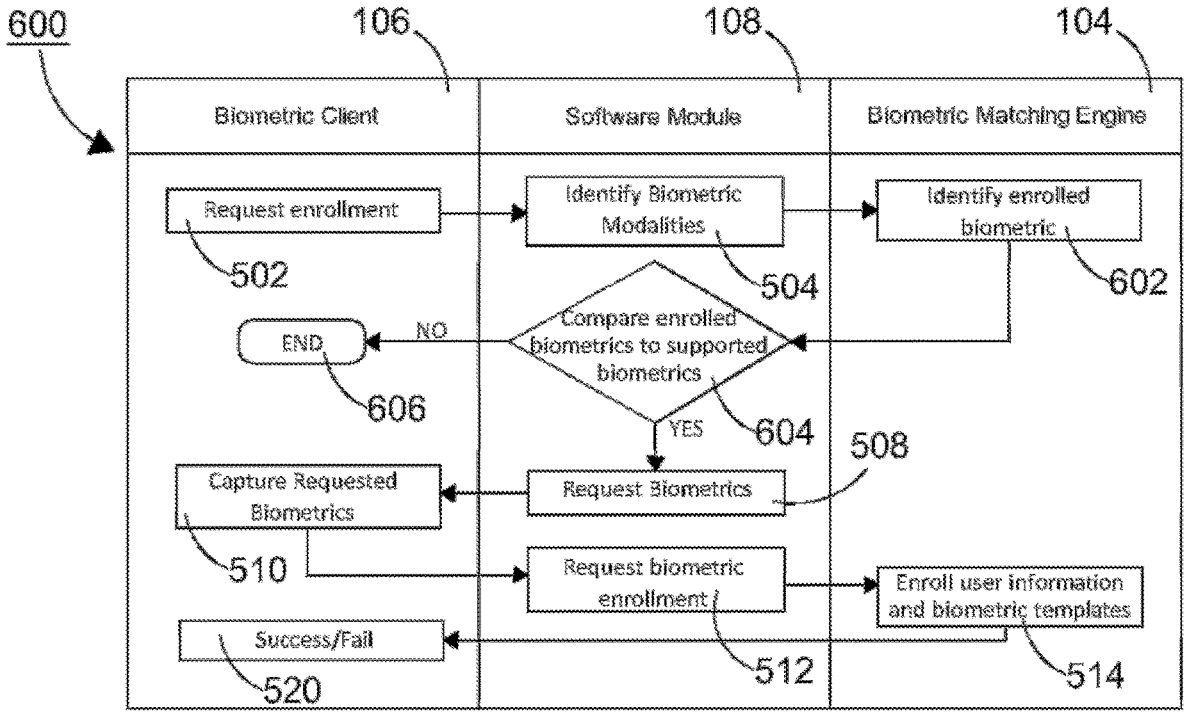
FIG. 6 illustrates a situational biometric enrollment process according to another embodiment of the invention.

FIG. 6 illustrates a situational biometric enrollment process 600 according to another embodiment of the invention. Here, the biometric modalities to be used for enrollment are determined depending on the biometric modalities already enrolled for that user. In another embodiment of the invention, a user may already be enrolled in an application and requests to enroll a new modality. The process begins when biometric client 106 requests (step 502). Software module 108 identifies which biometric client 106 is requesting enrollment in order to identify (step 504) biometric modalities 304 supported by biometric client 106. Software module 108 then identifies (step 602) biometric modalities enrolled for that user. Software module 108 then compares (step 604) enrolled biometrics to supported biometrics in order to determine which modalities can be enrolled.

For example, if biometric client 106 is using a device like a mobile phone that supports face (by taking a picture) and voice (by providing voice input through a microphone), software module 108 identifies both of the supported modalities for the mobile phone and compares them to the biometric modalities enrolled for that user; software module 108 then verifies that voice has already been enrolled for that user, therefore selecting face for enrollment. If no new modalities can be enrolled, the process ends (step 606). If additional modalities can be enrolled, the process continues to request (step 508) biometrics. Biometric client 106 then captures (step 510) requested biometrics and sends them to software module 108. Software module 108 then requests (step 512) biometric enrollment. Biometric matching engine 104 then enrolls (step 514) user information and biometric templates by storing biographic/demographic data along with the user's associated biometric templates in biometric data cache 102 for future authentication processes. Alternatively, biographic and demographic data is stored in separate data caches from biometric templates. Biometric client 106 then receives (step 520) a success/fail confirmation.

Figure 7:
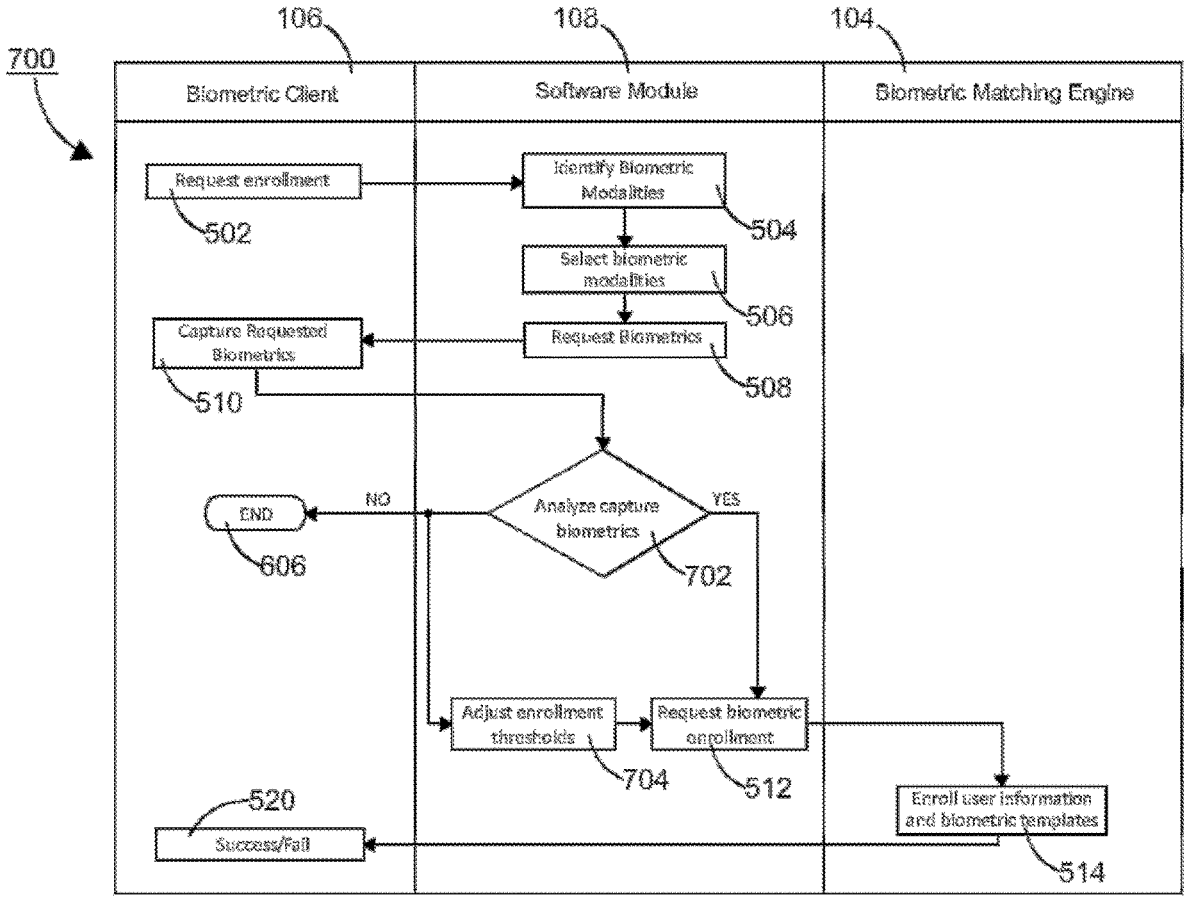
FIG. 7 illustrates a situational biometric enrollment process according to another embodiment of the invention.

FIG. 7 illustrates a situational biometric enrollment process 700 according to another embodiment of the invention. Here, the biometric thresholds for the biometric modalities are adjusted depending on the quality of the biometric capture. The process begins when biometric client 106 requests (step 502) an enrollment. Software module 108 then identifies (step 502) which biometric client 106 is requesting enrollment in order to identify (step 504) biometric modalities supported by biometric client 106. Software module 108 then selects (step 506) biometrics depending on the identified biometric modalities available for that biometric client 106 and requests (step 508) biometrics required for the enrollment. Biometric client 106 then captures (step 510) requested biometrics and sends them to software module 108. Software module 108 then analyzes (step 702) captured biometrics in order to determine if the quality of the captured biometrics are within a pre-determined threshold. If the captured biometrics from biometric client 106 are not within the pre-determined quality threshold, biometric client 106 is denied enrollment at which the process ends (step 606).

In another embodiment of the invention, software module 108 also contains a set of programmed rules to adjust enrollment thresholds 504 dynamically in order to accept biometric captures that are not within the first quality established threshold. For example, a user may be trying to enroll a voice biometric modality into a system while surrounded by a noisy environment, which affects the quality of the captured voice biometric. Software module 108 then adjusts the quality threshold in order to allow the voice biometric modality to be enrolled. Biometric matching engine 104 then enrolls user information and biometric templates 314 by storing biographic/demographic data along with the user's associated biometric templates in biometric data cache 102 for future authentication processes. Biometric client 106 may then receive a success/fail 320 confirmation.

Referring back to the bank application example, a user requests to enroll into the bank application using their smartphone. Biometric client 106 in this example is the smartphone. The smartphone in this example includes capture devices for voice and face. The bank application contains a software module 108 which determines that the enrollment request comes from a smart phone and that the supported biometrics are voice and face. The bank application requests captures for voice and face to biometric client 106. After voice and face biometrics are captured, the bank application store the user's demographic and biometric information in their respective databases for future authentications. The user is then informed of a successful enrollment through a user interface in their smartphone.

In another example, the user may have been previously enrolled in the bank application at a bank branch. The user may have enrolled biometric templates for fingerprint and face at the bank branch. The user requests to enroll a new biometric modality using their smartphone. The bank application contains a software module 108 which may then determine that the enrollment request comes from a smartphone and that the supported biometrics are voice and face. Software module 108 then verifies in biometric matching engine 104 what biometric modalities have already been enrolled for that user. Software module 108 then determines that face is already enrolled for that user but that voice may be added. The bank application the requests captures for voice. After voice is captured, the bank application stores the user's voice biometric in their respective databases and associates them to the user's demographic information for future authentications. The user is informed of a successful enrollment through a user interface in their smartphone.

In yet another example, a user requests to enroll into the bank application using their smartphone. The bank application contains a software module 108 which may then determine that the enrollment request comes from a smart phone and that the supported biometrics are voice and face. The bank application requests captures for voice and face to biometric client 106. After voice and face biometrics are captured, software module 108 then analyzes the captured biometrics and compares them to a pre-established biometric quality threshold. The quality for the voice captured biometric fails to be within the pre-established biometric quality threshold due to a noisy or loud environment. Software module 108 may take this into account and lower the pre-established biometric quality threshold in order to allow the enrollment of the voice biometric. After the adjustment of the biometric quality threshold, software module 108 analyzes the captured voice biometric and compares it to the new biometric quality threshold. If the captured voice biometric is within the new quality threshold, the bank application stores the user's demographic and biometric information in their respective databases for future authentications. The user is informed of a successful enrollment through a user interface in their smartphone.

One of ordinary skill in the art appreciates that the various illustrative logical blocks, modules, units, and algorithm steps described in connection with the embodiments disclosed herein can often be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular constraints imposed on the overall system Skilled persons can implement the described functionality in varying ways for each particular system, but such implementation decisions should not be interpreted as causing a departure from the scope of the invention. In addition, the grouping of functions within a unit, module, block, or step is for ease of description. Specific functions or steps can be moved from one unit, module, or block without departing from the invention.

The various illustrative logical blocks, units, steps and modules described in connection with the embodiments disclosed herein, and those provided in the accompanying documents, can be implemented or performed with a processor, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

The steps of a method or algorithm and the processes of a block or module described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium. An exemplary storage medium can be coupled to the processor such that the processor can read information from, and write information to, the storage medium. In the alternative, the storage medium can be integral to the processor. The processor and the storage medium can reside in an ASIC. Additionally, device, blocks, or modules that are described as coupled may be coupled via intermediary device, blocks, or modules. Similarly, a first device may be described a transmitting data to (or receiving from) a second device when there are intermediary devices that couple the first and second device and also when the first device is unaware of the ultimate destination of the data.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein.

I claim:

1. A method for biometric authentication of a user across a plurality of devices, the method implemented on a computer processor and comprising:

identifying, at the computer processor, an action request of the user of a first device of the plurality of devices;

determining, at the computer processor, a dynamic security level associated with the identified action request of the user of the first device;

determining, at the computer processor, a first set of one or more access biometric modalities supported by the first device;

determining, at the computer processor, a second set of one or more enrollment biometric modalities that the user has enrolled at a second device of the plurality of devices, wherein the first device and second device are different devices, and wherein the first device and the second device are each configured to capture physical biometric data directly from the user;

updating, at the computer processor in real time or near-real time, the dynamic security level based on information associated with the user and information associated with the identified action request;

selecting, at the computer processor, based on the determined dynamic security level, a plurality of biometric modalities common to both the determined first set of one or more access biometric modalities supported by the first device and the determined second set of one or more enrollment biometric modalities that the user has enrolled at the second device;

requesting, at the computer processor, a biometrics of the user for each one of the selected plurality of biometric modalities;

receiving, at the computer processor, the biometrics of the user for each one of the selected plurality of biometric modalities;

generating, at the computer processor, a biometric score for each one of the received biometrics that is compared to a respective biometric scoring threshold for each of the selected plurality of biometric modalities;

determining to dynamic change, at the computer processor, based on the determined dynamic security level, the respective biometric scoring threshold for each one of the selected plurality of biometric modalities; and determining, at the computer processor, for each one of the selected number of biometric modalities, whether the respective generated biometric score exceeds the respective determined biometric scoring threshold for each of the selected plurality of biometric modalities.

2. The method of claim 1, wherein the step of determining the dynamic security level is also based on location of the first device of the plurality of devices.

3. The method of claim 1, wherein the step of determining the dynamic security level is also based on type of the first device of the plurality of devices.

4. The method of claim 1, wherein the identified action request involves a monetary amount and the step of determining the dynamic security level is also based on the monetary amount.

5. The method of claim 1, wherein the identified action request involves remote access to information and the step of determining the dynamic security level is also based on the information's sensitivity.

6. The method of claim 1, further comprising granting the action request if, for each one of the selected plurality of biometric modalities, the respective generated biometric score exceeds the respective biometric scoring threshold based on the dynamic security level.

7. The method of claim 1, wherein the step of determining the dynamic security level is also based on identity of the user.

8. The method of claim 1, wherein the step of updating the dynamic security level further comprises increasing the dynamic security level.

9. The method of claim 1, wherein the physical biometric data captured directly from the user is associated with a physical trait selected from the group consisting of voice, face, fingerprint, and iris.

10. A method for biometric authentication of a user across a plurality of devices, the method implemented on a computer processor and comprising:

receiving, at the computer processor, identification of an action request of a user of a first device of the plurality of devices;

determining, at the computer processor, a dynamic security level associated with the received identification of the action request;

updating, at the computer processor, the dynamic security level based on information associated with the user;

determining, at the computer processor, a first set of a plurality of different biometric modalities supported by the first device of the plurality of devices;

determining, at the computer processor, a second set of a plurality of different biometric modalities that the user has enrolled at a second device of the plurality of devices, wherein the first device and the second device are different devices, and wherein the first device and the second device are each configured to capture physical biometric data directly from the user;

determining, at the computer processor, based on the determined dynamic security level associated with the received identification of the action request, a third set of a plurality of biometric modalities required for authentication of the user, wherein the third set of the plurality of biometric modalities are common to both the determined first set of the plurality of biometric modalities supported by the first device and the determined second set of the plurality of biometric modalities that the user has enrolled at the second device;

receiving, at the computer processor, biometric data, captured at the first device, for each biometric modality in the third set of the plurality of biometric modalities required for authentication of the user;

generating, at the computer processor, a biometric score for the received biometric data that is compared to a respective biometric scoring threshold associated with each biometric modality in the third set of the plurality of biometric modalities;

determining to dynamic change, at the computer processor, based on the determined dynamic security level, the respective biometric scoring threshold for each biometric modality in the third set of the plurality of biometric modalities; and determining, at the computer processor, for each biometric modality in the third set of the plurality of biometric modalities, whether the respective generated biometric score exceeds the respective determined biometric scoring threshold for each of the determined biometric modality in the third set of the plurality of biometric modalities.

11. The method of claim 10, wherein the step of determining the dynamic security level is also based on location of the first device of the plurality of devices.

12. The method of claim 10, wherein the step of determining the dynamic security level is also based on type of the first device of the plurality of devices.

13. The method of claim 10, wherein the identified action request involves a monetary amount and the step of determining the dynamic security level is also based on the monetary amount.

14. The method of claim 10, wherein the identified action request involves access to information and the step of determining the dynamic security level is also based on type of the information.

15. The method of claim 10, further comprising granting the action request if, for each biometric modality in the third set of one of the selected number of biometric modalities, the respective generated biometric score exceeds the respective biometric scoring threshold.

16. The method of claim 10, wherein the step of determining the dynamic security level is also based on identity of the user.

17. The method of claim 10, wherein the step of updating the dynamic security level further comprises increasing the dynamic security level.

18. The method of claim 10, wherein the physical biometric data captured directly from the user is associated with a physical trait selected from the group consisting of voice, face, fingerprint, and iris.

* * * * *